US007090626B1

(12) United States Patent
Miller

(10) Patent No.: US 7,090,626 B1
(45) Date of Patent: Aug. 15, 2006

(54) EXERCISE DEVICE

(76) Inventor: Daniel S. Miller, 8727 Ames Ave., Omaha, NE (US) 68134

( * ) Notice: Subject to any disclaimer, the term of this patent is extended or adjusted under 35 U.S.C. 154(b) by 571 days.

(21) Appl. No.: 10/132,850

(22) Filed: Apr. 23, 2002

(51) Int. Cl.
*A63B 21/00* (2006.01)

(52) U.S. Cl. ..... 482/139; 482/44; 482/45; 482/139

(58) Field of Classification Search ..... 482/44–46, 482/49, 133–139, 148; 601/23, 33, 40, 30
See application file for complete search history.

(56) References Cited

U.S. PATENT DOCUMENTS

| | | | | |
|---|---|---|---|---|
| 1,714,391 A | | 5/1929 | McWhirter | |
| 3,428,311 A | | 2/1969 | Mitchell | |
| 3,942,790 A | | 3/1976 | Rice | |
| 4,395,039 A | | 7/1983 | Kaiser | |
| 4,569,519 A | | 2/1986 | Mattox et al. | |
| 4,651,719 A | * | 3/1987 | Funk et al. | 601/33 |
| 5,179,939 A | * | 1/1993 | Donovan et al. | 601/33 |
| 5,558,624 A | | 9/1996 | Hepburn et al. | 601/33 |
| 5,645,521 A | * | 7/1997 | Hepburn et al. | 601/33 |
| 5,776,083 A | | 7/1998 | Jacob et al. | 601/23 |
| 6,129,650 A | | 10/2000 | Wedge, Jr. | 482/139 |
| 6,196,956 B1 | * | 3/2001 | Brown | 482/137 |
| 6,241,643 B1 | | 6/2001 | Loft et al. | 482/114 |
| 6,413,231 B1 | * | 7/2002 | Berman et al. | 601/38 |

FOREIGN PATENT DOCUMENTS

| | | |
|---|---|---|
| WO | WO 98/49990 | 11/1998 |

* cited by examiner

*Primary Examiner*—Glenn E. Richman
(74) *Attorney, Agent, or Firm*—Thomte, Mazour & Niebergall; Shane M. Niebergall

(57) ABSTRACT

The exercise device of the present invention includes an elongated rigid bar having a handle disposed at one end and a joint projection disposed at the opposite end. The joint projection is pivotably received by the joint collar of an exercise attachment. In an alternate embodiment, a second joint projection is provided at the opposite end of the exercise device to pivotably receive a second exercise attachment. The pivoting connection between the exercise attachments and the rod mimics normal biomechanical movement to decrease the chance of injury or re-injury to the user. The exercise device is telescopically extendable to selectively change its usable length.

20 Claims, 6 Drawing Sheets

EXERCISE DEVICE

BACKGROUND OF THE INVENTION

1. Field of the Invention

The present invention relates to exercise and rehabilitation devices, and more particularly to a telescopically adjustable exercise device that pivotably removably receives one or more exercise attachments for the manual exercise of an individual's upper extremities.

2. Description of the Prior Art

An injury to an individual's upper extremity, which may include the individual's shoulder, arm, elbow, wrist and/or the supportive tissue between the joints, typically requires some form of rehabilitation. Such rehabilitation generally involves the reestablishment of several physical aspects of the involved upper extremity. For example, depending on the particular injury sustained, an individual's range of motion is often significantly reduced after an upper extremity injury. Varying magnitudes of neuromotor inhibition and muscle atrophy are also experienced as a result of such injuries. Accordingly, the appropriate level of kinetic neuromotor control must be reestablished. The patient may also experience a measured loss in kinesthetic awareness, which must be reestablished in order to minimize the level of altered limb coordination and reaction time experienced by the patient. It is also important to reestablish the patient's functional activity so that they are able to return to a desired pre-morbid activity level without an unreasonable risk of re-injury or further degeneration. Ultimately, the patient is rehabilitated through the stages of healing beginning with the inflammatory stage, progressing through the proliferation stage, and completing the rehabilitation with the remodeling stage.

When reestablishing a patient's range of motion, it is important to initially limit the patient's muscle activity in the injured upper extremity. The introduction of passive range of motion at this stage of rehabilitation limits the risk of re-injury or irritation to the upper extremity. This is typically achieved through the passive movement of the injured arm by an external force such as an automated machine, a physical therapist, or the patient's unaffected arm. Those methods that allow the patient to self-articulate the injured upper extremity allow for a greater flexibility in the patient's rehabilitation program. Without the requirement of expensive machinery or a physical therapist, the patient is able to work on the exercises in the comfort of the patient's home at a time convenient for the patient.

One prior art method for allowing the patient to self-articulate the injured upper extremity typically involves the use of a broom handle. Using this method, the patient grasps opposite ends of the broom handle with both hands. The patient then uses his healthy arm and shoulder to move the broom handle reciprocally in vertical, horizontal or diagonal directions. These motions cause the patient's injured arm to move responsively through the upper extremities' available range of motion. This prior art method suffers from two serious problems. First, the rigid nature of the broom handle tends to force the injured arm in particular directions, irrespective of the natural range of motion provided by the joints and accompanying soft tissue. Forcing the injured upper extremity to travel in unnatural or undesired ranges of motion typically causes the patient to re-injure the upper extremity rather than rehabilitate it. Aside from its inability to mimic normal biomechanics, the broom handle method is also problematic in that it requires the active use of the muscles of the injured upper extremity to grip the broom handle, which works against the definition of passive range of motion.

An example of a prior art device that was developed in an effort to address the problems encountered when a patient uses an exercise device such as a broom handle is disclosed in U.S. Pat. No. 4,395,039. The device itself is comprised of an elongated bar having opposite ends. One end is adapted to be gripped by the patient's healthy arm. The opposite end of the bar is attached to one end of an elastic cord that has a gripping handle disposed at the opposite end. In use, the patient grips the gripping handle with his injured arm. The patient then uses his healthy arm to articulate the exercise bar in a manner similar to that using the broom handle. The device improves upon the broom handle method by providing some passive range of motion that is not as rigidly dictated by the exercise bar as a patient will experience with the broom handle. However, this device can achieve a range of motion in the injured upper extremity that is too independent of the movement of the exercise bar. Due to the flexible nature of the elastic cord, the device lacks an element of precision when directing the injured upper extremity through a desired range of motion. Moreover, this device, much like the broom handle, must be actively gripped by the patient's injured arm. Again, this is inconsistent with the goals of passive range of motion exercises.

The next stage of the rehabilitation process is the reestablishment of kinetic neuromotor control at specific sequences throughout the injured upper extremities' range of motion. This goal can be attained through graded isotonic muscle activity of synergistic-specific muscles or muscle groups within the injured upper extremity while providing a measured level of graded force from the healthy upper extremity. None of the prior art exercise devices can provide this necessary element while simultaneously allowing multiplane joint-independent range of motion without the necessity of active motor work at the distal end of the injured upper extremity.

In the next stage of rehabilitation, the patient engages in restrictive range of motion exercises to regain the strength necessary to achieve an active range of motion in the injured extremity, independent of any external assistance. In order to safely transition a patient to functional active ranges of motion independent of assistance, it is preferred that the exercise device used by the patient support both open kinetic chain and closed kinetic chain exercises. Moreover, an exercise tool used in this stage of rehabilitation should support agonist, antagonist, isometric and isotonic muscle activity through graded forces applied through both the injured and healthy upper extremities. None of the prior art exercise devices are capable of such a flexible utility. Accordingly, multiple exercise tools must be used in an attempt to safely attain an active range of motion.

Accordingly, what is needed is a single exercise device that supports the rehabilitation of an injured extremity through normal biomechanics. More importantly, the exercise should safely benefit the patient's rehabilitation from the passive range of motion stage through the achievement of active independent ranges of motion by the injured upper extremity.

SUMMARY OF THE INVENTION

The exercise device of the present invention is provided with an elongated rod having a gripping end and a working end. A joint projection is operatively connected to the working end of the exercise bar to pivotably receive an infinite number of exercise attachments that are provided with an exposed joint collar. The joint projection and joint collar can be removably engaged with one another so that they form a pivoting ball socket, which attains a fluid range of motion in nearly any direction.

A plurality of exercise attachments are provided for use by the patient throughout the several stages of rehabilitation. In one embodiment, the exercise attachment is formed to conform with the palmar surface of the patient's hand, which is comfortably secured thereto using an adjustable strap.

In another embodiment, the length of the exercise attachment is increased to extend beyond the patient's wrist along the patient's injured arm to selectively immobilize the patient's wrist. An example of other embodiments of the exercise attachment may provide an upper surface having a dome shape so that the patient's hand comfortably remains in the functional position as needed.

In yet another embodiment, the exercise attachment is provided with a generally planar upper surface to engage flat work surfaces such as a floor, wall or ceiling to assist the patient in active range of motion exercises.

Regardless of their embodiments, the exercise attachments of the present invention are interchangeably received by the joint projection of the exercise bar. An alternate embodiment of the exercise bar provides a second joint projection on the opposite end of the exercise bar so that two exercise attachments can be used simultaneously for specific rehabilitative exercises. In still another embodiment, the exercise bar can be provided with selectively lockable telescoping extension bars so that the exercise device can be used by different patients of different sizes as well as adapt with each patient as their ranges of motion increase.

It is therefore a principle object of the invention to provide an exercise device that provides a patient with normal biomechanical motion during use.

Yet another object of the invention is to provide an exercise device that is adaptable for a plurality of different exercises throughout the various stages of rehabilitation.

Still another object of the present invention is to provide an exercise device that is selectively extendable in length to incrementally increase the ranges of motion attained during use.

Yet another object of the present invention is to provide an exercise device that supports passive range of motion exercises.

Yet another object of the present invention is to provide an exercise device that supports active range of motion exercises.

Still another object of the present invention is to provide an exercise device that is portable and easy to use.

These and other objects will be apparent to those skilled in the art.

DESCRIPTION OF THE PREFERRED EMBODIMENT

Figure 1:
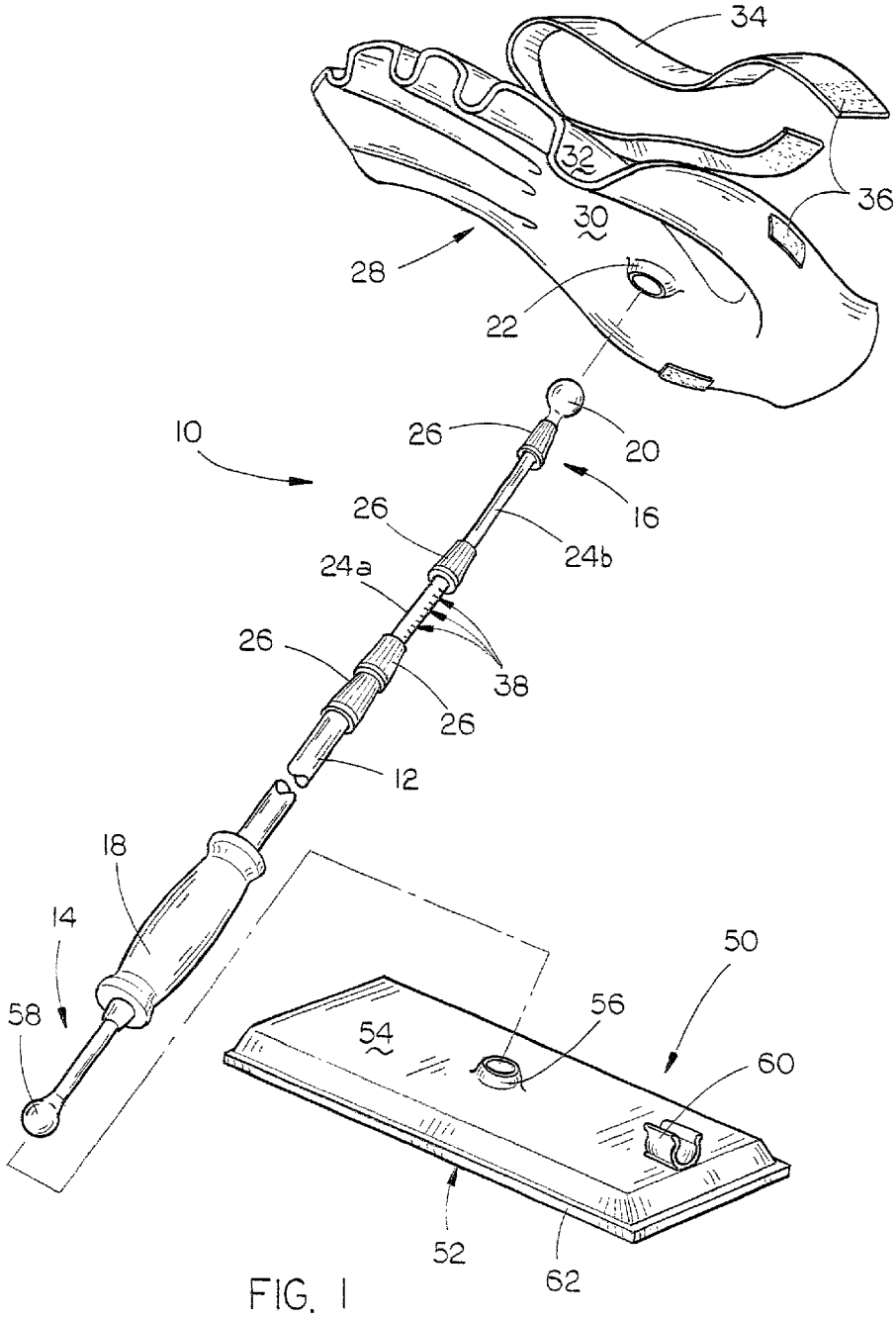
FIG. 1 is a perspective view of the exercise device of the present invention with two optional exercise attachments.

The exercise device of the present invention is generally designated by the number 10 in FIGS. 1–6. For the purposes of description only, the exercise device 10 will be described as an instrument to be used by a patient for the rehabilitation of an injured upper extremity. It is contemplated that the exercise device 10 can be used for purposes other than rehabilitation, such as the exercising of an individual's upper extremities for strength, toning, or agility-building purposes. Moreover, it is further contemplated that the exercise device 10 could be used in the therapy of patients having a degenerative condition or other physical impairment other than an injury to an otherwise healthy upper extremity.

The exercise device 10 is preferably comprised of an elongated rigid rod 12 having a first end portion 14 and a second opposite end portion 16. The first end 14 of the exercise device 10 is adapted to be gripped by the patient using his arm opposite the injured upper extremity. A handle 18 is preferably provided adjacent the lower portion 14 to provide the patient with a consistent gripping location that is comfortable and resists slipping from the user's hand. To this end, several known materials such as foam, rubber, plastic, wood and some metals will suffice.

The exercise device 10 is provided with a joint projection 20 adjacent the second end portion 16. The joint projection 20 represents one of the component parts to a point of connection between the exercise device 10 and one of a number of exercise attachments. For reasons that are discussed hereinbelow, it is preferred that the connection between the exercise device and the exercise attachments be one that is capable of fluidly pivoting in nearly any direction. Accordingly, it is preferred that joint projection 20 have a generally spherical shape. This shape is generally suited to be releasably received by a generally circular collar 22, forming a ball and socket joint connection. This structure provides a selectably releasable connection between the exercise device 10 and the exercise attachments that is able to pivot and rotate simultaneously. It is contemplated, however, that this same effect could be accomplished through the use of a joint projection shaped in the form of a pin to be hingedly connected to a collar having a rotatable base.

To accommodate patients of different sizes and rehabilitation needs, the rod 12 can be made to be selectively extendable in length. This is accomplished by providing one or more extension rods 24 that can be telescopically received within one another and ultimately within elongated rod 12. In use, the patient is able to grasp the elongated bar 12 and simply pull the extension rods 24 from within the bar 12. Once the exercise device 10 has achieved the desired length, a locking ring 26 is slidably and lockably connected to the extension bar 24 to secure the extension bar 24 in its extended position with respect to either the bar 12 or an adjacent extension bar 24. For example, FIG. 1 depicts extension bars 24A and 24B, which have been at least partially extended from within bar 12. In this position, the patient can selectively secure extension bars 24A and 24B with respect to each other and the bar 12 by tightening the associated locking rings 26. It is contemplated that other structures could be used to provide the locking function for the extension rods 24. For example, outwardly biased spring structures could be located on the extension bars 24 or within the bar 12 to provide frictional engagement. A multitude of holes could be disposed within the extension bars 24 and the bar 12 that could be aligned and secured with respect to one another using a pin or similar structure.

Figure 2:
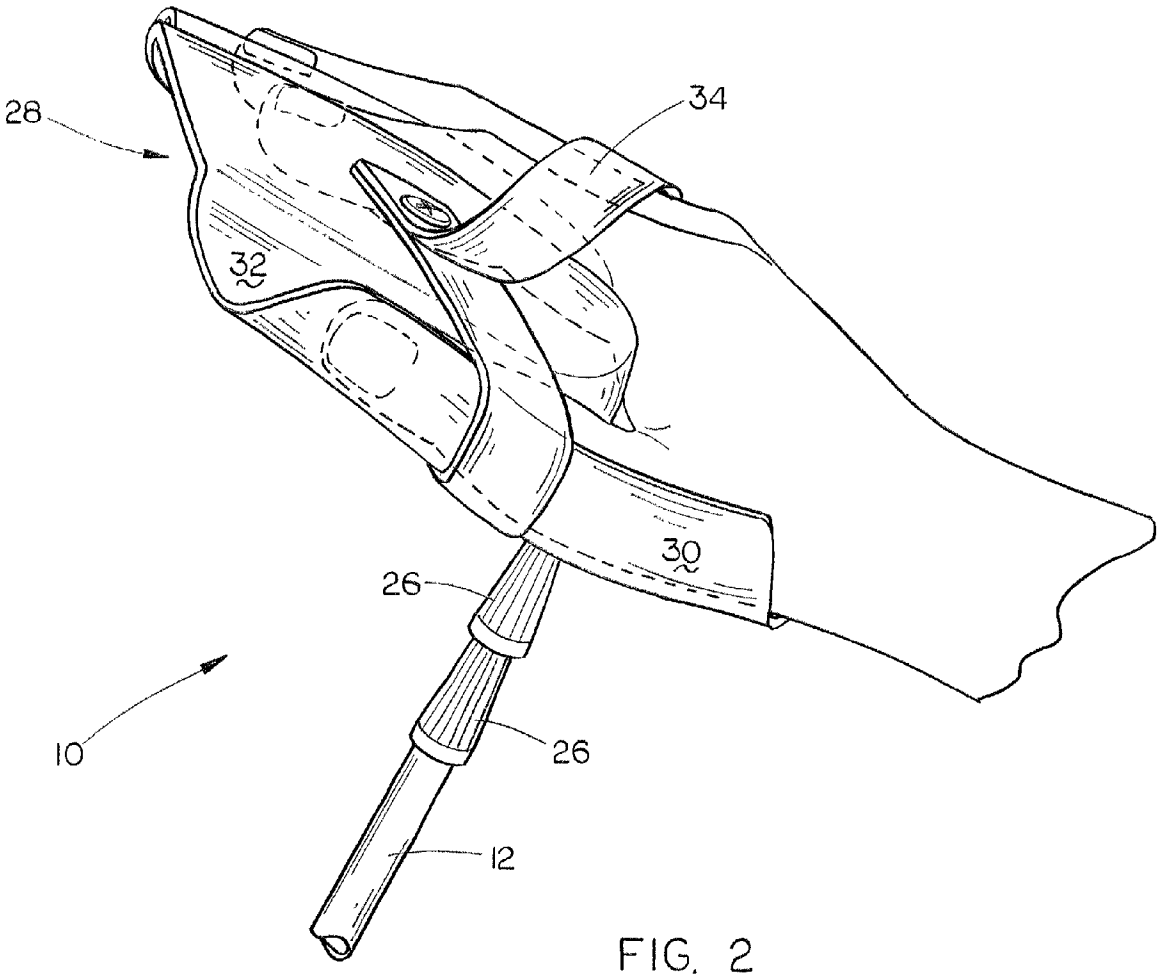
FIG. 2 is a side perspective view of an exercise attachment being used in conjunction with the exercise device of the present invention.
Figure 4:
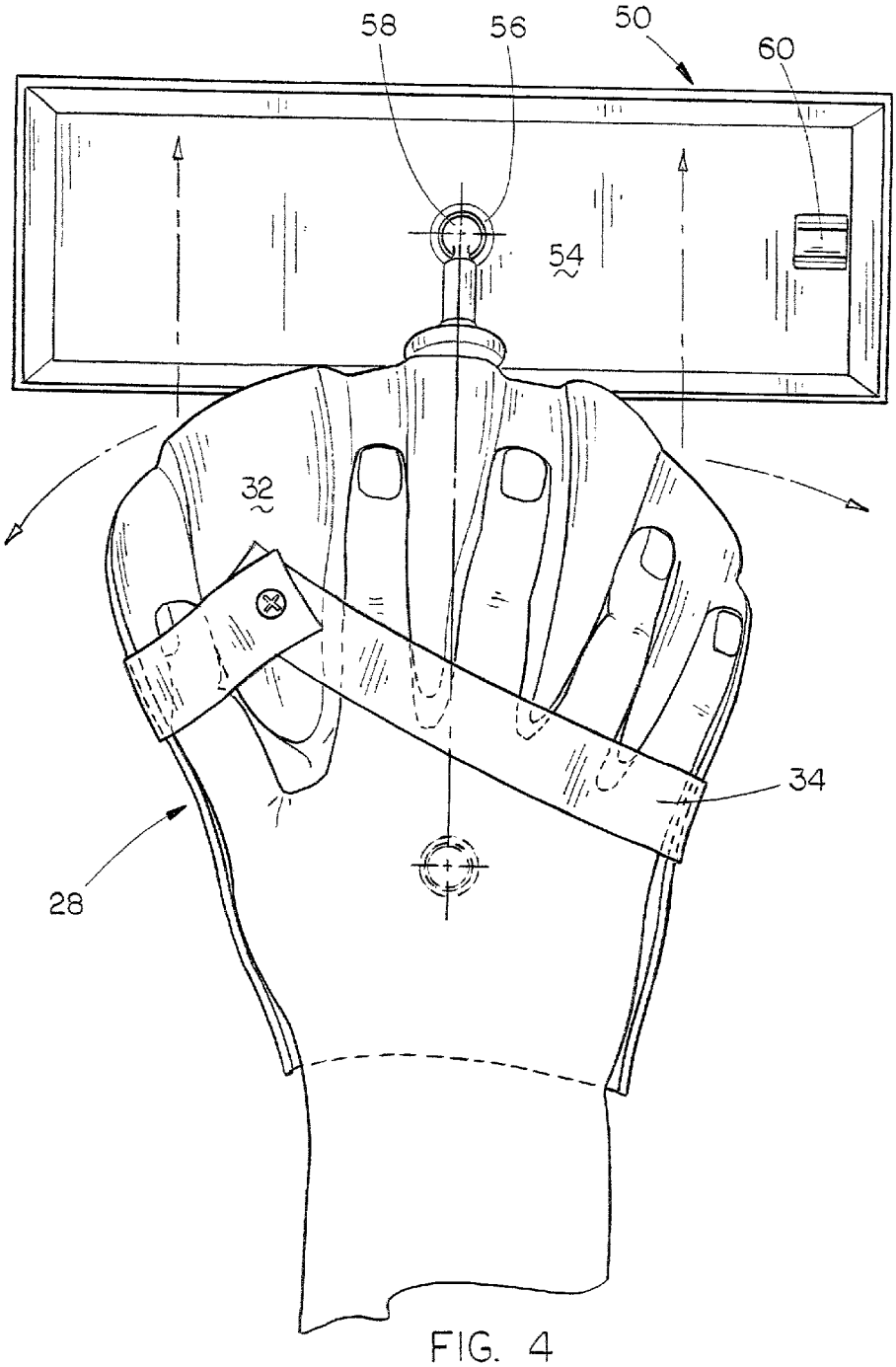
FIG. 4 is a plan view of the exercise device and exercise attachments of FIG. 3.

An endless number of exercise attachments can be used in conjunction with the exercise device 10. For example, FIGS. 1, 2 and 4 illustrate a hand attachment 28 having a lower surface 30 and an upper surface 32. As shown in FIGS. 1, 2 and 4, the upper surface 32 of hand attachment 28 has been molded so that it generally conforms to the patient's hand in a substantially extended position. It is contemplated that the hand attachment 28 could be formed to receive the patient's hand in nearly any degree of extension, including a generally functional position where the palmar surface of the patient's hand curves, to some degree, upon itself.

A strap 34 is provided to secure the patient's hand to the top surface 32 of hand attachment 28. The strap 34 is preferably made from an elastic material to extend across the upper surface 32 to provide a snug but comfortable fit. It is contemplated, however, that generally non-elastic materials such as leather, plastic and some fabric materials could be used. The strap 34 is secured in position over the patient's hand using Velcro tabs 36. Other connectors, such as snaps, hooks, buckles, or ties could also be used.

In use, the patient secures the joint projection 20 within joint collar 22, which is formed or secured onto the bottom surface 30 of hand attachment 28. The patient then secures his hand from the injured upper extremity between the upper surface 32 of hand attachment 28 and the strap 34. The user may then grasp the handle portion 18 with his opposite hand. In this position, the patient can manipulate the exercise device 10 in a reciprocating up and down, crosswise, or diagonal position, whichever is required by the prescribed exercise. With the hand from the injured upper extremity being secured to the hand attachment 28, minimal, if any, active participation is required by the muscles of the upper extremity. This allows the patient to explore the complete passive range of motion of the injured upper extremity. The joint projection 20 and joint collar 22 pivot throughout the exercise in a fluid manner so as not to force the injured upper extremity into an abnormal biomechanical fashion. In essence, the joint projection 20 and joint collar 22 become a joint, similar to the shoulder, elbow and wrist, making the exercise device 10 a seamless extension of the patient's upper extremity.

As the patient's range of motion increases, the patient can make incremental increases to the length of the exercise device 10 using the extension rods 24 and locking rings 26. To gauge the progress of the patient's passive range of motion, a plurality of indicators 38 can be provided along the length of one or more of the extension bars 24.

Figure 5:
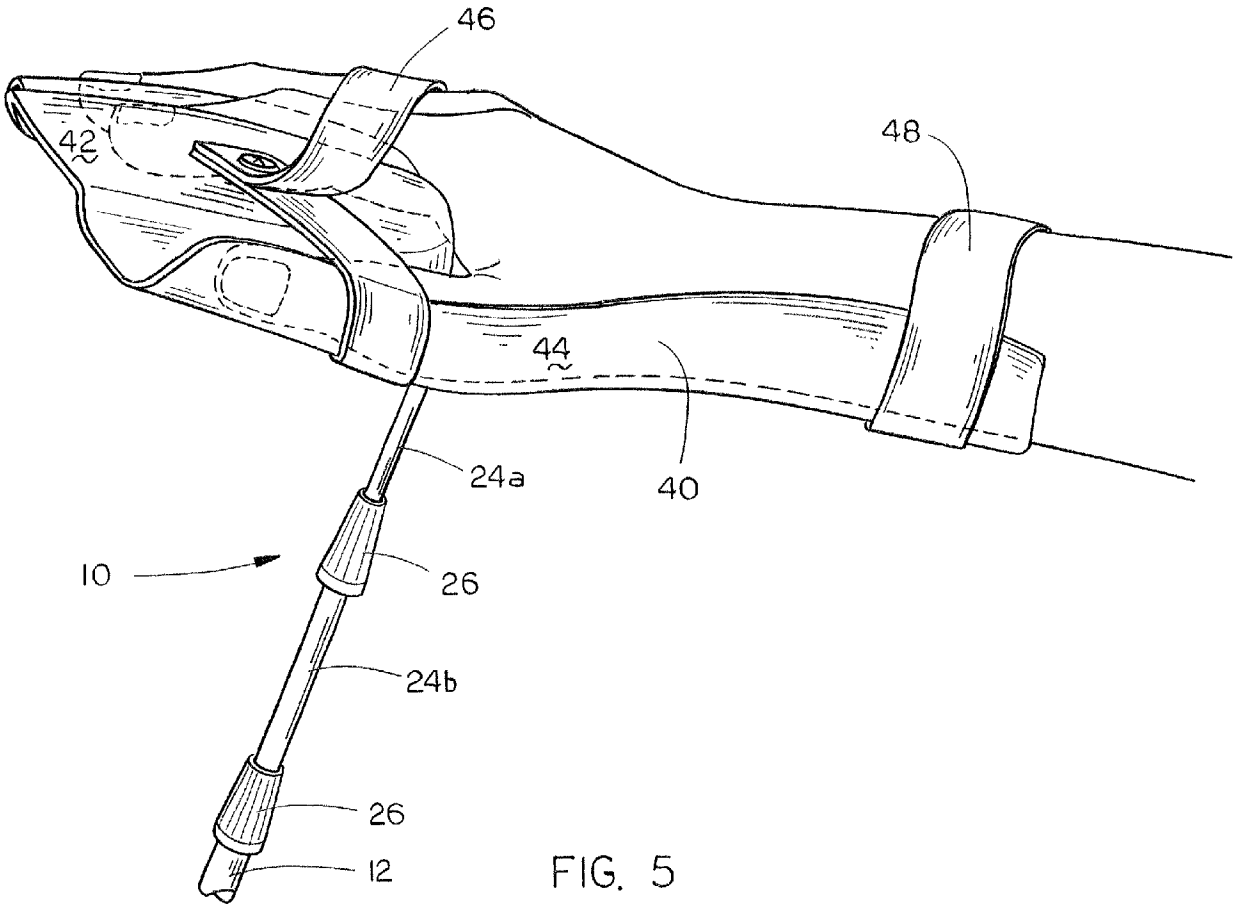
FIG. 5 is a side perspective view of an alternate embodiment of the exercise attachment of FIG. 2.
Figure 6:
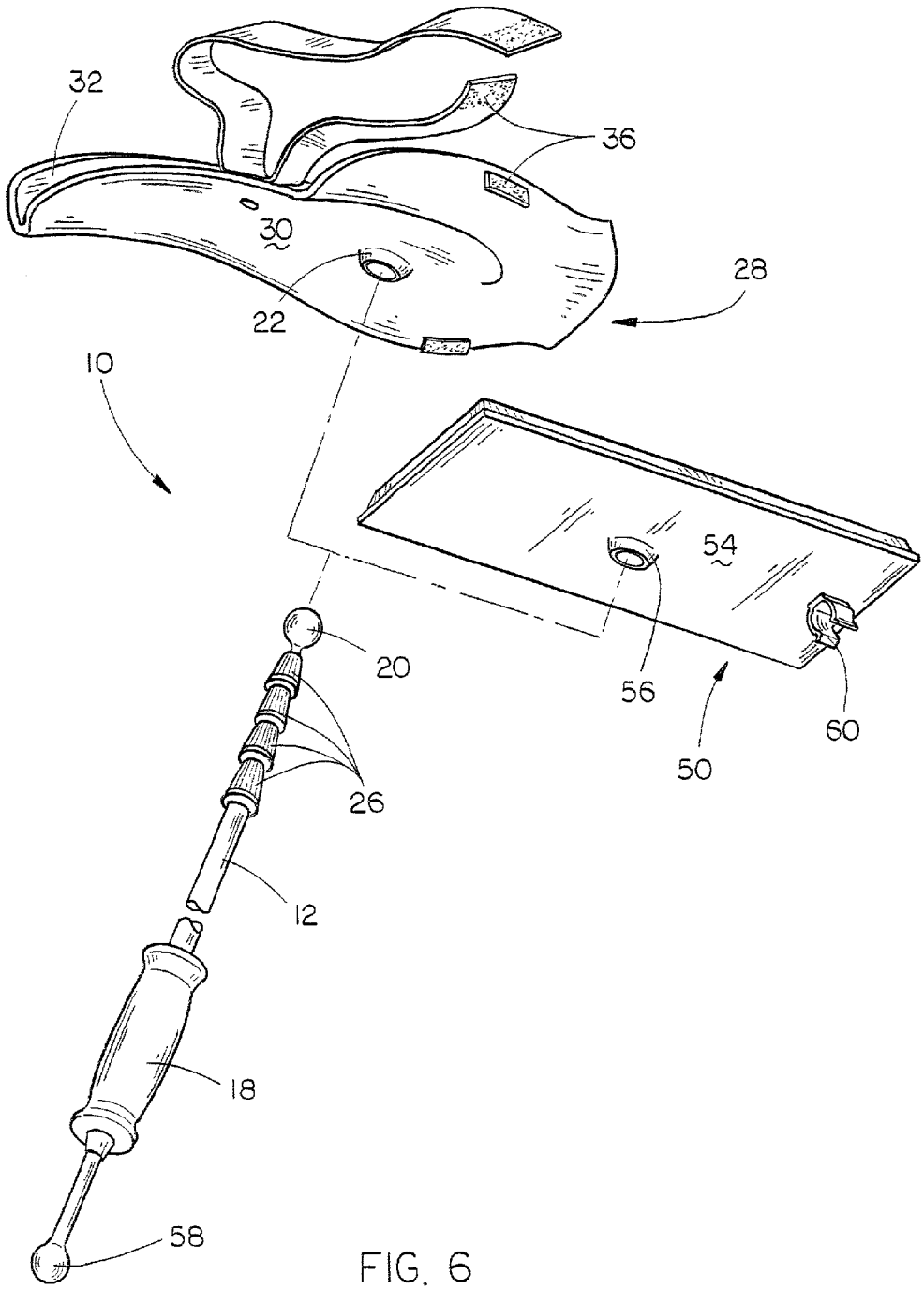
FIG. 6 is a side perspective view of the exercise device of the present invention depicting the interchangeable nature of the exercise attachments of FIG. 1.

When it is necessary or otherwise desirable to restrict one or more of the joints in the patient's injured upper extremity, the hand attachment 28 can be increased in length and shaped accordingly. FIG. 5 depicts a hand attachment 40 that has a length sufficient to extend from the distal end of the patient's hand to a point along the patient's arm sufficient to prevent the patient's wrist from bending while the patient's upper extremity is exercised. It is contemplated that the length of the hand attachment 40 could be increased to extend beyond the patient's elbow and set at a particular angle to provide further joint restriction and restrict particular planes of movement by the patient's upper extremity during exercise. The hand attachment 40 is otherwise functionally similar to the hand attachment 28 in that it has a shaped upper surface 42 and a lower surface 44 that is pivotably connected to the exercise device 10. Due to the increased length, however, hand attachment 40 may need to be provided with a plurality of straps 46 and 48, as deemed necessary.

Figure 3:
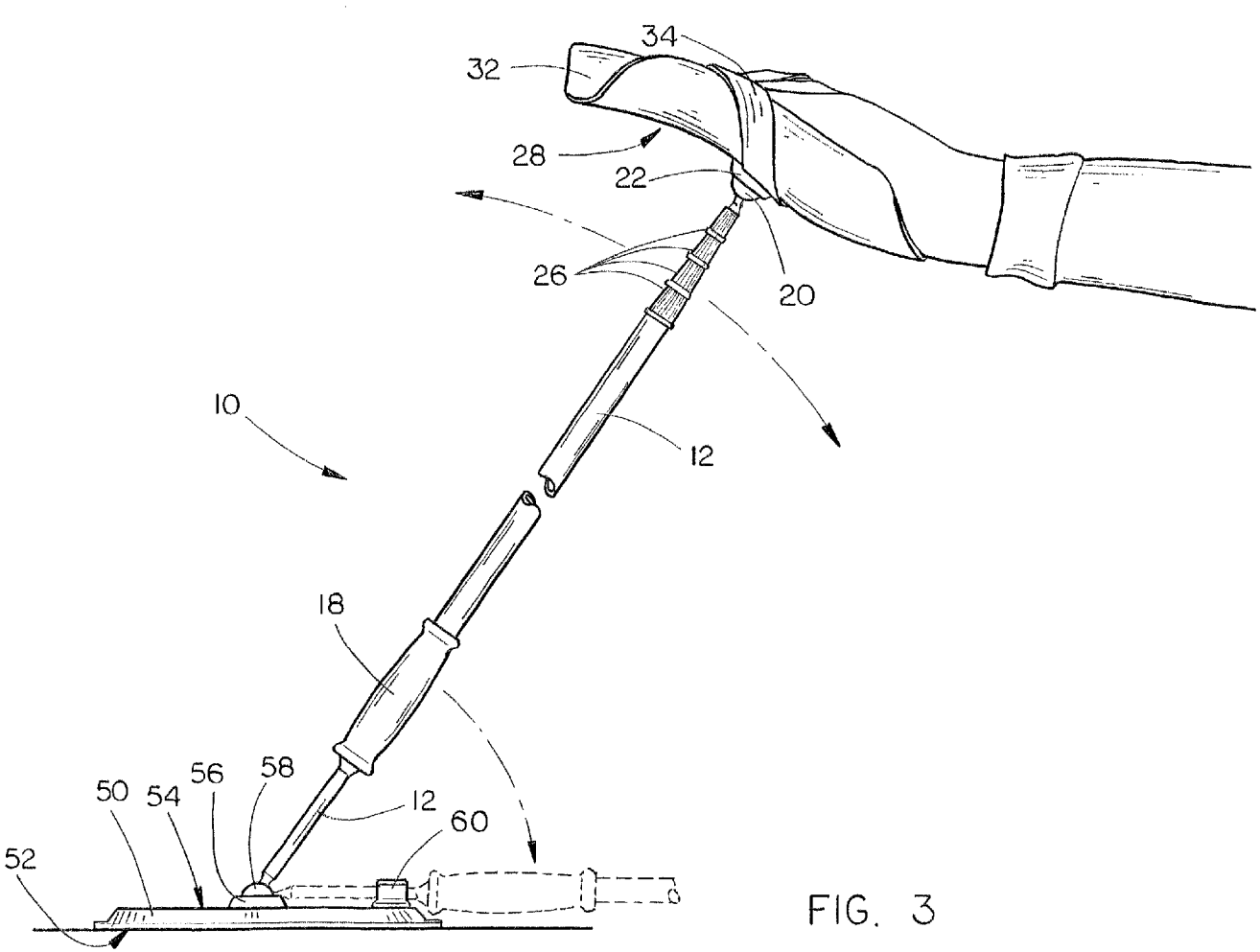
FIG. 3 is a side elevation view of the exercise device and exercise attachments of FIG. 1 as the same could be used in one exercise embodiment of the present invention.

A surface attachment 50 is provided with a generally planar lower surface 52 and an upper surface 54. The upper surface 54 of surface attachment 50 is provided with a collar portion 56 that is similar in function and structure to the aforementioned joint collar 22. The joint collar 56 is adapted to releasably and pivotably receive a joint projection 58 extending from the first end portion 14 of rod 12. Joint projection 58 is similar in structure and function to joint projection 20. In fact, each of the exercise attachments can be optionally secured to either of the joint projections 20 or 58 at the opposite end portions 16 and 14 of the exercise device 10. A clip 60 is provided on the top surface 54 of surface attachment 50 and is sized to releasably engage bar 12 when the surface attachment 50 is pivoted to a position that is generally parallel to bar 12 as shown in FIG. 3.

In use, the surface attachment 50 can be pivotally connected to joint projection 20. The patient is then able to grasp the handle 18 and engage the planar surface 52 of surface attachment 50 against another generally planar surface, such as a floor, wall, or ceiling. In this position, the patient is able to articulate the exercise device in a number of reciprocating motions with respect to the surface attachment 50, as shown in FIGS. 3 and 4. The patient is therefore provided with a structure that enables a variation in range of motion exercises as well as a method of initiating active assistance range of motion exercises. In another exercise embodiment, the surface attachment 50 is pivotably secured to joint projection 58; and the hand attachment 28, or other suitable attachment, is pivotably secured to joint projection 20. This provides the patient with the ability to perform passive range of motion exercises by minimizing the need of active participation by the muscles in the injured upper extremity. The patient engages the lower surface 52 of the surface attachment 50 with a generally planar surface and articulates the exercise device 10 in a reciprocating motion using the hand attachment 28 rather than handle 18.

In the drawings and in the specification, there have been set forth preferred embodiments of the invention; and although specified items are employed, these are used in a generic and descriptive sense only, and not for purposes of limitation. Changes in the form and proportion of parts, as well as substitute of equivalents, are contemplated as circumstances may suggest or render expedient without departing from the spirit or scope of the invention as further defined in the following claims.

Thus, it can be seen that the invention accomplishes at least all of its stated objectives.

I claim:

1. A device for exercising a hand, arm, shoulder and upper extremity of a user, comprising:

an elongated bar having first and second end portions and a joint projection adjacent the second end portion of said bar; said first end portion of said bar providing a free end of said bar, which is adapted to be gripped by a first hand of the user; and an exercise attachment having an upper surface and a lower surface; said lower surface of said exercise attachment being shaped to engage said joint projection in a manner that forms a swiveling connection between said exercise attachment and the second end portion of said bar.

2. The device of claim 1 wherein the lower surface of said exercise attachment is provided with at least one joint collar that is shaped to releasably swivelably receive said joint projection.

3. The device of claim 2 wherein the upper surface of said exercise attachment is shaped to releasably secure a hand of the user thereto.

4. The device of claim 3 wherein said exercise attachment has a length sufficient to at least extend upwardly from a palm portion of the user's hand toward the user's shoulder at least partially beyond a wrist portion of the user's arm.

5. The device of claim 4 further comprising a plurality of joint collars extending from the lower surface of said exercise attachment in a spaced relationship with one another along the length of said exercise attachment; said joint collars each being adapted to individually releasably receive said joint projection in a manner that forms a swiveling connection between said exercise attachment and the second end portion of said bar.

6. The device of claim 1 wherein the upper surface of said exercise attachment is shaped to conform to a shape defined by the user's hand in a generally extended position.

7. The device of claim 1 wherein the upper surface of said exercise attachment is generally dome shaped so that the user can easily grip the exercise attachment with a single hand.

8. The device of claim 2 further comprising an elongated strap operatively coupled with opposite side portions of said exercise attachment in such a manner that permits the user to place the user's hand in a secure position between the upper surface of said exercise attachment and said strap.

9. The device of claim 1 further comprising at least one elongated extension bar that is telescopically received within the second end portion of said bar so that the user can selectively telescopically extend said at least one extension bar to selectively extend the length of said bar.

10. The device of claim 9 further comprising at least one locking ring operatively connected to said at least one extension rod to selectively lock said extension rod in a telescopic position with respect to said bar.

11. The device of claim 10 further comprising a plurality of extension distance indicators disposed along the length of said at least one extension rod in spaced relation to one another to indicate a distance of telescopic extension of said extension bar with respect to said bar.

12. The device of claim 1 further comprising a handle operatively secured to said bar adjacent the first end portion thereof; said handle being adapted to be gripped by the user for manual manipulation of the device.

13. The device of claim 1 further comprising a second joint projection adjacent the first end portion of said bar.

14. The device of claim 13 further comprising a second exercise attachment having an upper surface and a generally planar lower surface; said upper surface of said second exercise attachment being shaped to engage said second joint projection in a manner that forms a swiveling connection between said second exercise attachment and the first end portion of said bar; said lower surface of said second exercise attachment being adapted to releasably engage a generally planar working surface.

15. The device of claim 14 wherein the upper surface of said exercise attachment is provided with at least one joint collar that is shaped to releasably swivelably receive said second joint projection.

16. The device of claim 15 wherein said exercise attachment and said second exercise attachment are operatively releasably connected to said first and second end portions of said bar.

17. The device of claim 15 wherein said exercise attachment and said second exercise attachment are interchangeably operatively coupled to said first and second end portions of said bar.

18. A method of exercising, comprising the steps of:

providing an exercise device comprising;

an elongated bar having first and second end portions and a joint projection adjacent the second end portion of said bar; said first end portion of said bar being adapted to be gripped by a first hand of the user; and an exercise attachment having an upper surface and a lower surface; said lower surface of said exercise attachment being operatively pivotably connected to said joint projection;

engaging a first hand with the upper surface of said exercise attachment;

grasping the first end portion of said bar with a second hand in such a manner that said exercise device is substantially supported above an operating surface by said second hand; and articulating the first end portion of said bar with said second hand such that an arm and upper extremity coupled with said first hand are selectively moved through a passive range of motion.

19. The method of claim 18 further comprising the steps of:

providing said exercise device with at least one elongated extension bar that is telescopically received by the second end portion of said bar; and adjusting a position of said at least one extension bar with respect to said bar to extend or reduce the length of said bar by a select distance, prior to the step of articulating the first end portion of said bar with said second hand.

20. The method of claim 19 further comprising the steps of:

providing said exercise device with a second joint projection, adjacent the first end portion of said bar, and a second exercise attachment, having an upper surface and a lower surface; said upper surface of said second exercise attachment being shaped to engage said second joint projection in a manner that forms a swiveling connection between said second exercise attachment and the first end portion of said bar; said lower surface of said second exercise attachment being adapted to releasably engage an operating surface;

engaging the lower surface of said second exercise attachment with an operating surface; and articulating said first exercise attachment with said first hand such that said arm is selectively moved through a range of motion.

* * * * *